US005862969A

United States Patent [19]

Lee

[11] Patent Number: 5,862,969

[45] Date of Patent: Jan. 26, 1999

[54] SAFETY TRIGGER FOR NAILER

[75] Inventor: Yun-Chung Lee, Taipei Hsien, Taiwan

[73] Assignee: De Poan Pneumatic Corporation, Taipei Hsien, Taiwan

[21] Appl. No.: 932,635

[22] Filed: Sep. 17, 1997

[51] Int. Cl.[6] ..... B25C 1/04

[52] U.S. Cl. ..... 227/8; 227/130

[58] Field of Search ..... 227/8, 120, 130, 227/135

[56] References Cited

U.S. PATENT DOCUMENTS

| | | | |
|---|---|---|---|
| 4,629,106 | 12/1986 | Howard et al. | 227/8 |
| 5,083,694 | 1/1992 | Lemos | 227/130 |
| 5,137,197 | 8/1992 | Bauer | 227/130 |
| 5,366,132 | 11/1994 | Simonelli | 227/8 |
| 5,551,621 | 9/1996 | Vallee | 227/8 |
| 5,683,024 | 11/1997 | Eminger et al. | 227/8 |
| 5,692,663 | 12/1997 | Yang | 227/8 |

*Primary Examiner*—Scott A. Smith

*Attorney, Agent, or Firm*—Pro-Techtor International Services

[57] ABSTRACT

The present invention relates to a safety trigger for a nailer, which is used to eject nails into a work object through a muzzle, with a gliding bar being pushed upward, when the muzzle is set on the work object, allowing an ejection switch to be operated, the safety trigger comprising: a trigger body, hingedly mounted on the nailer and operating the ejection switch when pulled up; a blocking part, rotatably mounted on a transverse shaft through the trigger body, either pointing towards a peripheral surface around the ejection switch or pointing aside, thus blocking or allowing the operation of the ejection switch by the trigger body; and a spring around the shaft, leaning against the gliding bar and against the blocking part; wherein, when the muzzle of the nailer is set on the work object and the gliding bar is consequently pushed upwards, the blocking part is turned aside, allowing the trigger body to be pulled upwards and operate the ejection switch, and when the muzzle is taken away from the work object, the trigger body and the blocking part return to an original position, with the blocking plates preventing the trigger body from touching the ejection switch.

2 Claims, 7 Drawing Sheets

SAFETY TRIGGER FOR NAILER

BACKGROUND OF THE INVENTION

1. Field of the Invention

The present invention relates to a safety trigger for a nailer, particularly to a safety trigger which allows ejecting nails only after pressing the nailer on a work object.

2. Description of Related Art

For the safety of workers and their environment, conventional nailers are provided with a safety device, which has a gliding bar connected to the muzzle of the nailer. When the nailer is pressed on the work object, the gliding bar moves back, enabling the trigger. This kind of safety device prevents injuries caused by ejecting nails from a freely held nailer. However, some users, in order to increase their working efficiency, have the habit of already pulling the trigger, before the nailer is set on the work object. If incidentally the nailer is pushed against another object or another person, a nail is released, often causing injuries. So a conventional safety device still relies on proper use by the worker.

SUMMARY OF THE INVENTION

An object of the present invention is to provide a safety trigger for a nailer, which is safer.

Another object of the present invention is to provide a safety trigger for a nailer, which allows to notice easily any misuse.

The present invention can be more fully understood by reference to the following description and accompanying drawings.

DETAILED DESCRIPTION OF THE PREFERRED EMBODIMENT

Figure 1:
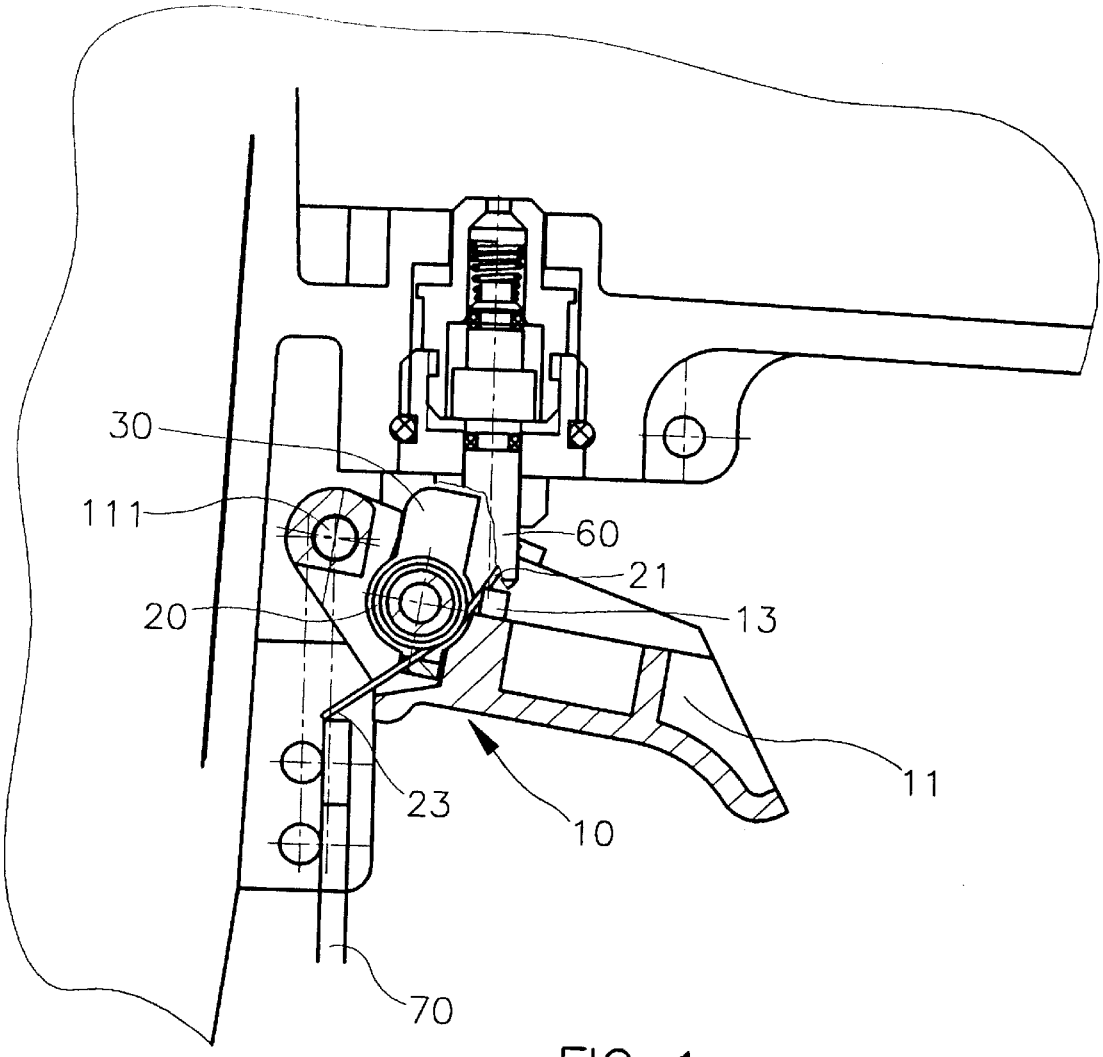
FIG. 1 is a schematic illustration of the present invention, showing the assembly of the structural parts thereof.

As shown in all Figs., the safety trigger of the present invention is for use in a nailer with a muzzle, allowing the ejection of nails only after pressing the nailer on a work object. The muzzle defines a lower end of the nailer. The safety trigger of the present invention mainly comprises a trigger 10 with a trigger body 11, a spring 20, a blocking part 30, an ejection switch 60, and a gliding bar 70. The spring 20 and the blocking part 30 are mounted on the trigger body 11. When the nailer is set on the work object, the gliding bar 70 is pushed upward, turning and displacing the blocking part 30 and thus allowing the trigger body 11 to close the ejection switch 60. When the gliding bar 70 is not pushed upward, the blocking part 30 is held by the elastic force of the spring 20 in an original position, wherein the trigger body 11 is blocked from moving, such that the ejection switch 60 will not be closed.

Figure 2:
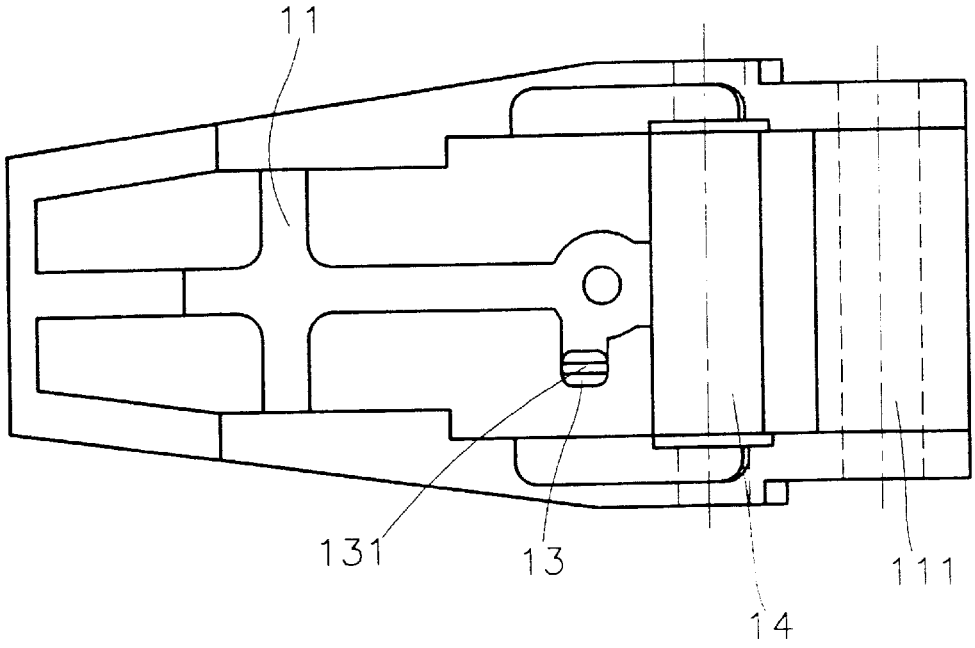
FIG. 2 is a top view of the trigger body of the present invention.
Figure 3:
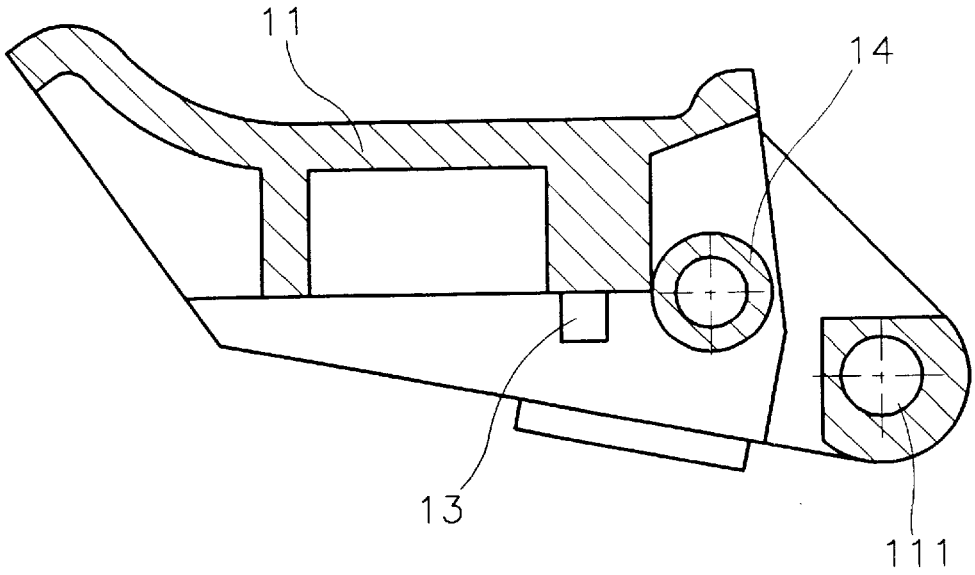
FIG. 3 is a side view of the trigger body of the present invention.
Figure 4:
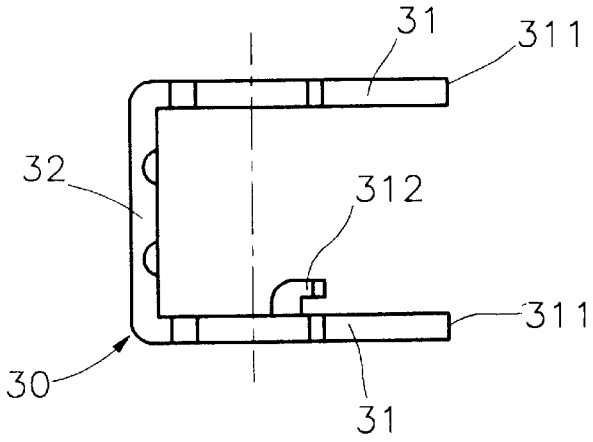
FIG. 4 is a front view of the blocking part of the present invention.
Figure 5:
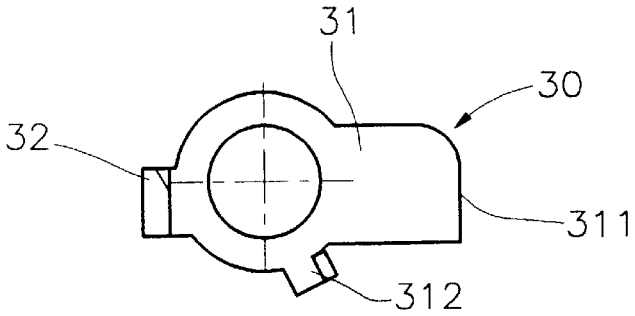
FIG. 5 is a side view of the blocking part of the present invention.
Figure 6:
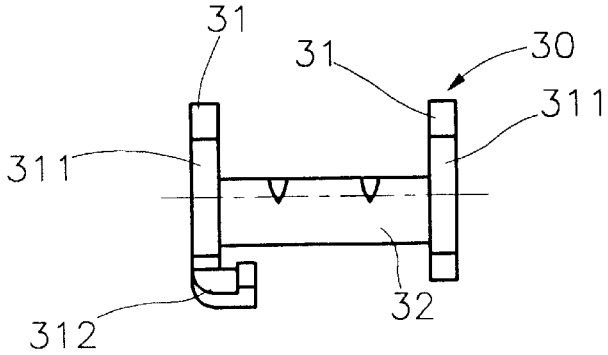
FIG. 6 is a top view of the blocking part of the present invention.

Referring to FIGS. 1–3, the trigger body 11 is an elongated body with a longitudinal groove, mounted a certain distance below the ejection switch 60. The trigger body 11 has a front end 111, which is hingedly connected to the nailer, such that the trigger body 11, when the trigger 10 is pulled, is turned around the front end 111 to be brought in contact with the ejection switch 60. A blocking support 13 is attached to the trigger body 11, having a first blocker 131 for leaning against one of the ends of the spring 20. Close to the front end 111 of the trigger body 11, a shaft 14 passes therethrough perpendicular to the longitudinal direction thereof. On the shaft 14, the blocking part 30 is rotatably mounted, serving to prevent the trigger body from moving towards the ejection switch 60 and touching it.

Referring to FIGS. 1 and 4–6, the blocking part 30 has one or several blocking plates 31, which extend upward, towards the ejection switch 60. The blocking part 30 is rotatable around the shaft 14. The upper ends of the blocking plates 31 form flat surfaces 311. When the trigger body 11 is pulled up towards the ejection switch 60, the flat surfaces 311 bump against a peripheral surface around the ejection switch 60, preventing the trigger body 11 from touching the switch 60. To one of the blocking plates 31 a second blocker 312 is attached, leant against by one of the ends of the spring 20 for taking the elastic force thereof. When the spring 20 presses against the second blocker 312 and the trigger body 11 is pulled up towards the ejection switch 60, the flat surfaces 311 avoid bumping against the peripheral surface around the ejection switch 60, allowing the trigger body 11 to touch the switch 60 for ejecting a nail.

The blocking part 30 further has on its lower side a lower plate 32, which is parallel to the shaft 14 and leans against the spring 20.

Figure 7:
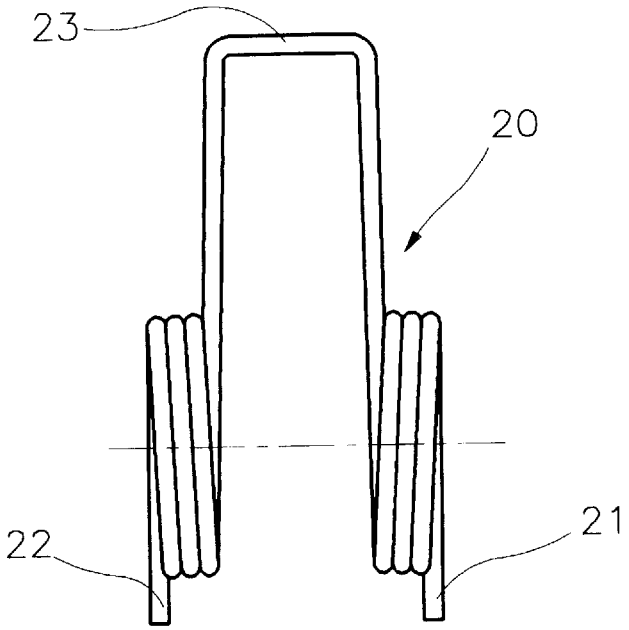
FIG. 7 is a top view of the spring of the present invention.
Figure 8:
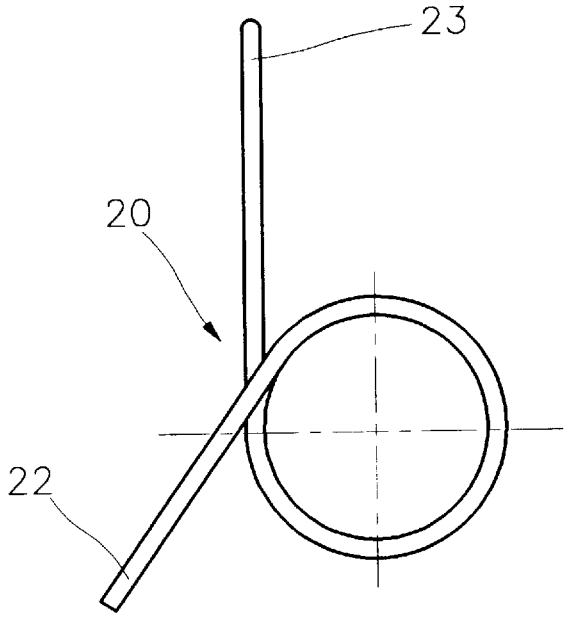
FIG. 8 is a side view of the spring of the present invention.
Figure 9:
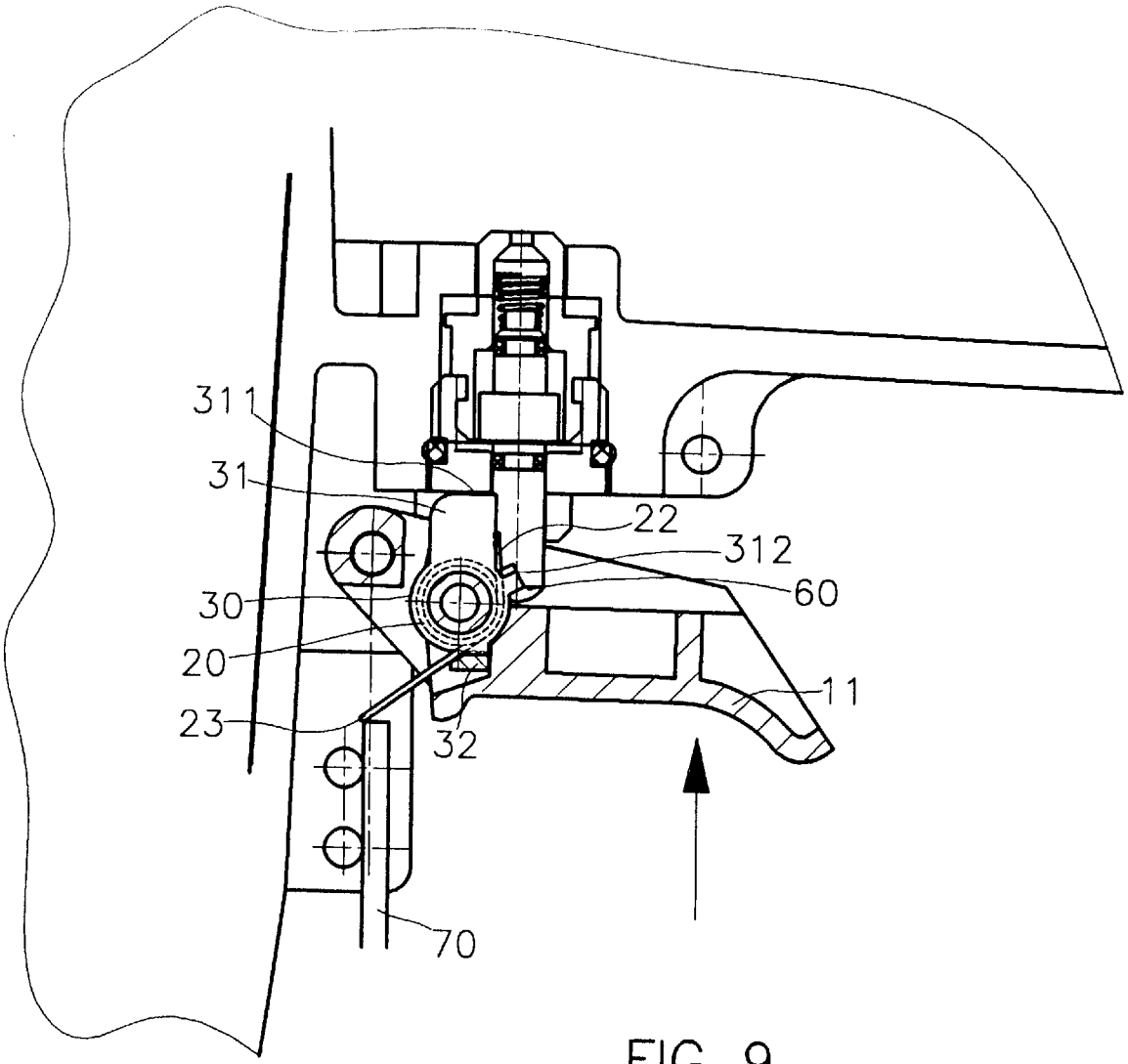
FIG. 9 is a schematic illustration of the movement of the present invention, showing how, without pushing and turning the blocking part, the trigger cannot be released and the ejection switch cannot be closed.
Figure 10:
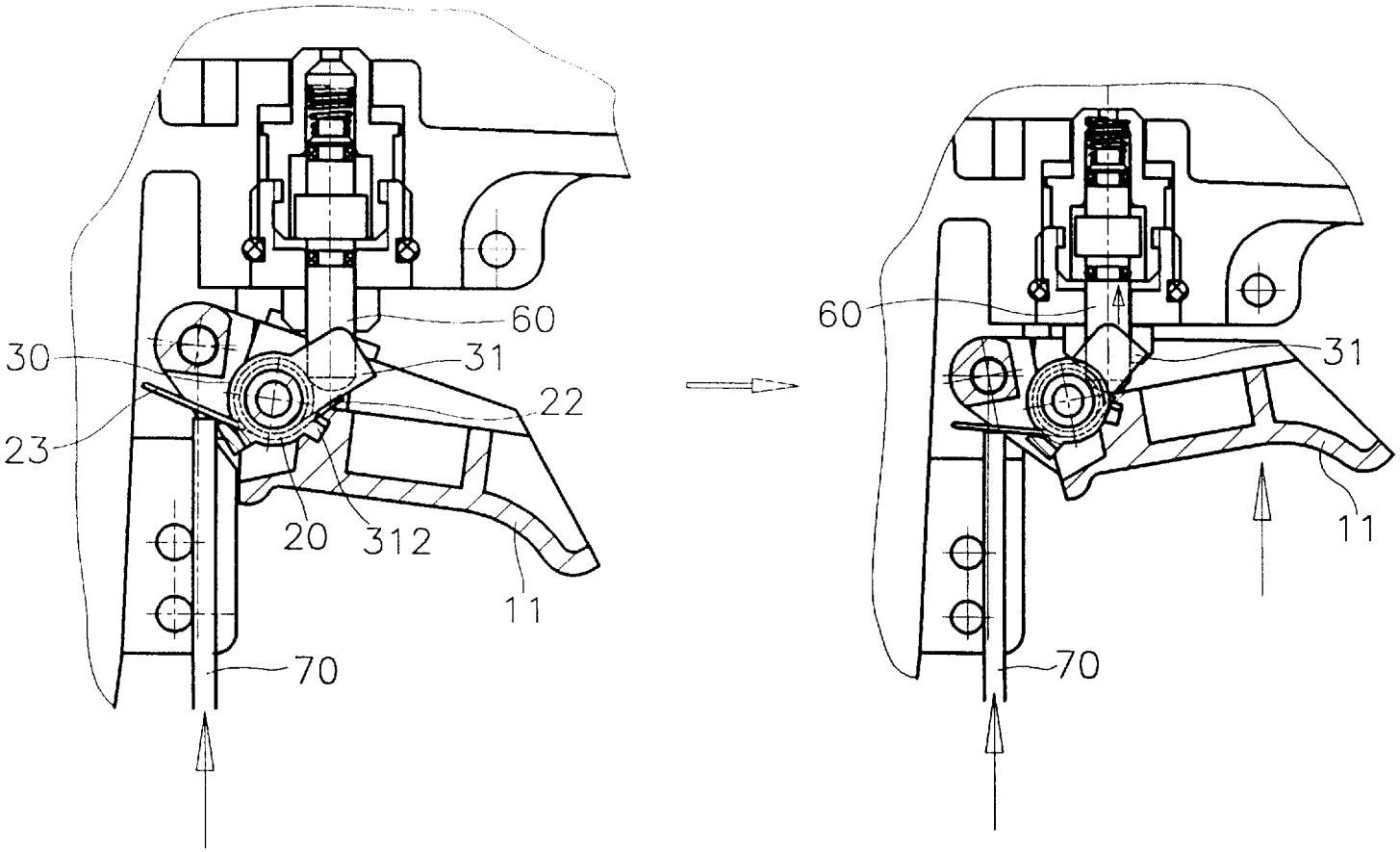
FIG. 10 is a schematic illustration of the movement of the present invention, showing how, after pushing the spring by the gliding bar and then pulling the trigger, ejection of nails is enabled.
Figure 11:
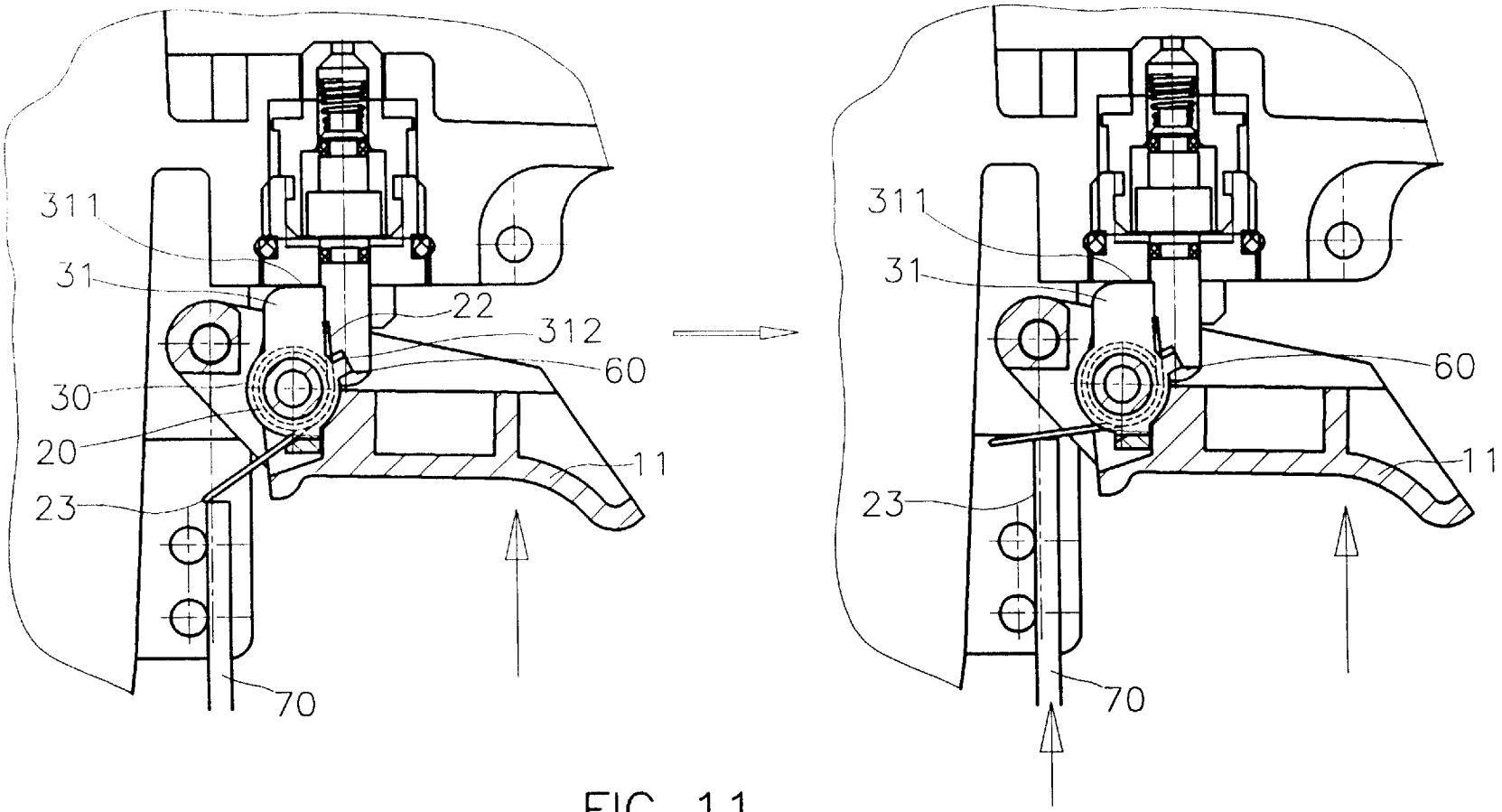
FIG. 11 is a schematic illustration of the movement of the present invention, showing how, after pulling the trigger and then pushing the gliding bar, no ejecting of nails is possible.

Referring to FIGS. 1 and 7–8, the spring 20 comprises two connected, coaxial spiral halves surrounding the shaft 14. The spring 20 has a first end 21, which leans against the first blocker 131 on the trigger body 11, and a second end 22, which leans against the second blocker 312 of the blocking part 30 (as shown in FIG. 9) for turning the blocking part 30 by a certain angle. A U-shaped middle section 23 connects the two spiral halves. The middle section 23 leans against the lower plate 32 of the blocking part 30, extending beyond it by a certain distance down to the gliding bar 70. (The gliding bar 70 is of conventional technology and so needs no further explaining.) So the middle section 23 is moved by pushing the gliding bar 70 upward.

While the nailer is held freely, the muzzle not touching any object, all structural parts are in a original position. As shown in FIGS. 1 and 9–11, when the muzzle of the nailer is pressed on the work object and the gliding bar 70 is pushed upward, the middle section 23 of the spring is turned around the shaft 14 on the trigger body 11 by a certain angle.

Then the second end 22 of the spring presses against the blocking part 30, turning the flat surfaces 131 thereof aside by a certain angle. After pulling the trigger 10 in this state, the trigger body 11 touches the ejection switch 60 unhindered. Since the first end 21 of the spring 20 presses against the first blocker 131 on the trigger body 11, too, a counterforce against pulling the trigger 10 is exerted. When the muzzle of the nailer is taken away from the work object and the gliding bar 70 has moved downward again, the spring 20 turns back to the original position. The middle section 23 of the spring presses against the lower plate 32 of the blocking part 30, causing the blocking plates 31 to return to the original position, wherein the blocking plates 31 point to the peripheral surface around the ejection switch 60 and prevent the trigger body 11 from touching the switch 60. When the trigger 10 is pulled and then the gliding bar 70 is pushed up, the blocking plates 31 lean against the peripheral surface around the ejection switch 60, such that the blocking plates 31 cannot be turned aside. Thereby injuries by careless use of the nailer are avoided.

I claim:

1. A safety trigger for a nailer, which is used to eject nails into a work object through a muzzle, with a gliding bar being pushed upward, when said muzzle is set on said work object, allowing an ejection switch to be operated, said muzzle defining a lower end of said nailer, said safety trigger comprising:

a trigger body of elongated shape with a longitudinal groove and a front end, said front end being hingedly mounted on said nailer, turnable around a transverse axis, said trigger body being separated from said ejection switch by a certain distance and, after being pulled upwards, touching said ejection switch, said trigger body close to said front end further being passed through by a transverse shaft;

a blocking element with a lower end, rotatably mounted on said shaft, having two blocking plates extending towards said ejection switch for leaning against a peripheral surface adjacent said ejection switch, said blocking element further having a first blocker on one of said blocking plates and a lower plate on said lower end parallel to said transverse axis; and a spring with two connected, coaxial spiral halves surrounding said shaft, having a first end, which leans against said trigger body, a second end, which leans against said first blocker, and a middle section, which connects said two halves and leans against said lower plate of said blocking element and against said gliding bar;

wherein, when said muzzle of said nailer is set on said work object and said gliding bar is consequently pushed upwards, said middle section of said spring is turned around said shaft by a certain angle, such that said blocking element is also turned around said shaft, allowing said trigger body to be pulled upwards and operate said ejection switch, and when said muzzle is taken away from said work object, said trigger body and said blocking element return to an original position, with said blocking plates leaning against a peripheral surface adjacent said ejection switch and preventing said trigger body from touching said ejection switch.

2. A safety trigger for a nailer according to claim 1, wherein said trigger body has a second blocker, engaged with said first end of said spring.

* * * * *